US010799901B2

(12) United States Patent
Langsdale

(10) Patent No.: US 10,799,901 B2
(45) Date of Patent: Oct. 13, 2020

(54) MOUNTABLE APPARATUS FOR THE REMOTE DISCHARGE OF CANISTERS FOR POSTERIOR SKIN APPLICATION

(71) Applicant: Michael Langsdale, San Diego, CA (US)

(72) Inventor: Michael Langsdale, San Diego, CA (US)

( * ) Notice: Subject to any disclaimer, the term of this patent is extended or adjusted under 35 U.S.C. 154(b) by 0 days.

(21) Appl. No.: 16/193,585

(22) Filed: Nov. 16, 2018

(65) Prior Publication Data

US 2020/0156097 A1 May 21, 2020

(51) Int. Cl.
*B05B 12/02* (2006.01)
*B65D 83/20* (2006.01)
*B65D 83/16* (2006.01)

(52) U.S. Cl.
CPC ..... *B05B 12/02* (2013.01); *B65D 83/202* (2013.01); *B65D 83/203* (2013.01); *B65D 83/205* (2013.01)

(58) Field of Classification Search
CPC .... B05B 12/02; B65D 83/202; B65D 83/203; B65D 83/205
See application file for complete search history.

(56) References Cited

U.S. PATENT DOCUMENTS 2,720,422 A 10/1955 Mercur
2,830,742 A 4/1958 Gibbons
3,017,056 A * 1/1962 Bishop ..... B65D 83/203 222/164
3,229,859 A * 1/1966 Conroy ..... A47L 1/08 222/174
3,485,206 A * 12/1969 Smrt ..... E01C 23/227 118/305
3,716,195 A * 2/1973 Silva ..... B65D 83/203 222/174
3,856,209 A * 12/1974 Hickson ..... B65D 83/203 211/170
4,089,440 A * 5/1978 Lee ..... B65D 83/202 222/174
4,111,338 A * 9/1978 Cheng ..... B65D 83/386 222/180
4,457,472 A 7/1984 Geberth, Jr.
4,579,258 A 4/1986 Brown
4,607,875 A 8/1986 McGirr
4,660,745 A 4/1987 Hess, Jr.
(Continued)

FOREIGN PATENT DOCUMENTS

DE 4236050 A1 11/1993

*Primary Examiner* — Frederick C Nicolas
(74) *Attorney, Agent, or Firm* — Lee & Hayes, P.C.

(57) ABSTRACT

A spray canister holding apparatus that includes a collar for connecting to a spray canister, made of a non-continuous circular gripping structure having at least one opening along a circumference of the circular gripping structure, a lever arm rotation member, a vertical backing member attached to a posterior continuous portion of the circular gripping structure and extending upwards from the circular gripping structure, and a wire support opening connected to the circular gripping structure. The apparatus also includes a lever arm on the collar, a connecting wire attached to the lever arm, a handgrip attached to the connecting wire, and a discharging nodule appended to the lever arm, where the discharging nodule acts on a spray canister dispenser button.

20 Claims, 5 Drawing Sheets

(56) References Cited

U.S. PATENT DOCUMENTS 4,872,721 A 10/1989 Sniadach
4,886,191 A * 12/1989 Yoshitomi ..... B05C 17/10 222/174
5,307,959 A * 5/1994 Bedore ..... B05B 15/62 222/174
5,368,202 A 11/1994 Smrt
5,518,148 A * 5/1996 Smrt ..... B65D 83/202 222/174
5,855,297 A * 1/1999 Tichenor ..... B65D 83/262 222/153.11
5,904,273 A 5/1999 Aspacher
5,931,591 A 8/1999 McCracken
6,129,469 A 10/2000 Messer
6,261,014 B1 7/2001 Altobellis
6,318,600 B1 11/2001 Winnet
6,364,177 B1 * 4/2002 Taylor ..... B65D 83/202 222/402.15
6,450,423 B1 9/2002 Gurule
6,505,759 B2 * 1/2003 Holyfield ..... A61L 9/12 222/180
6,663,307 B2 12/2003 Kopanic et al.
6,966,461 B2 * 11/2005 Warner ..... B65D 83/203 222/174
7,040,510 B1 * 5/2006 Hester ..... B05B 11/3056 222/174
7,234,673 B2 6/2007 Graneto, III
7,252,210 B1 * 8/2007 Schultz ..... B65D 83/203 222/174
7,314,149 B1 * 1/2008 White ..... B65D 83/203 222/174
7,316,334 B1 * 1/2008 Brody ..... B65D 83/202 222/153.09
7,717,300 B1 * 5/2010 Yarrusso, Jr. ..... A01M 1/2038 222/174
7,726,521 B2 * 6/2010 Bassett ..... A47K 5/12 222/180
8,444,020 B1 * 5/2013 Kenny ..... B65D 83/203 222/162
8,757,514 B1 * 6/2014 Perello ..... B05B 15/60 239/280.5
8,887,963 B2 11/2014 Zizoune et al.
9,422,148 B1 8/2016 Strickland, Jr.
2002/0018687 A1 2/2002 Owings
2005/0211729 A1 * 9/2005 Bassett ..... A47K 5/12 222/181.3
2007/0170205 A1 6/2007 Walker
2010/0084434 A1 4/2010 Rhoades
2015/0008240 A1 1/2015 Davis

* cited by examiner

MOUNTABLE APPARATUS FOR THE REMOTE DISCHARGE OF CANISTERS FOR POSTERIOR SKIN APPLICATION

BACKGROUND

The disclosed subject matter is in the field of skincare and protection.

Sun exposure can lead to adverse health consequences, both long and short term. An immediate danger of too much sun is a sunburn, which damages skin cells and blood vessels. However, whether or not a burn is visible, skin can be harmed by prolonged or repetitive sun exposure. Sun damage as such results in unhealthy, discolored, and weakened skin with long term consequences that include wrinkles, premature skin aging, and skin cancer.

Sunscreens are an effective product to protect the skin from harmful UV rays. However, for sunscreen to be effective, it must be applied to all exposed areas of skin. The relative inaccessibility to the back leaves the back vulnerable to sun damage, as it is a difficult spot to reach, especially for the elderly and those suffering with arthritis or shoulder injuries. Even where the physical fitness of an individual permits one to reach their back, limited range of arm motion results in uneven application of sunscreen, leaving some areas unprotected.

Current products targeted towards product application to the back utilize rigid, bulky handles, and many require a user to reach their arm over and behind their head, a difficult and sometime impossible task for those with injuries or arthritic conditions. Further, the rigid handles are non-adjustable, requiring repetitive flexion of the elbow. Thus, a need exists for an easier and more effective application of protective products to the skin, particularly to the skin on the back.

In view of the foregoing, an object of this specification is to disclose a self-supporting apparatus that holds a skin-protectant product container and enables a user to remotely discharge the contents of the container. In a typical embodiment, the device features a collar that grips an aerosol spray canister around the actuator. The collar may then be fixated to a vertical surface via attachment means, suspending the aerosol canister at the attached height. A lever arm is connected to the collar at one distal end and a wire is connected to the opposite distal end of the lever arm. The wire extends to a hand pump that, upon squeezing of the handle, pulls the wire and causes the lever arm to pivot and depress the actuator of the canister secured in the collar.

In a typical embodiment, the lever arm exhibits a series of openings through which removable nodules of varying sizes may be affixed. The nodules make contact with the canister actuator when the lever arm pivots, discharging the contents of the canister. Varying sized nodules may be removed and inserted to compensate for the differing proximity of the actuator to the lever arm amongst different sized aerosol canisters to ensure the actuator is depressed upon a pulling of the wire on the distal end of the lever arm. Further, the nodules may be laterally adjusted along the lever arm and connected via insertion into the series of openings.

In another embodiment, the collar features magnets, a loop, a suction cup, or other gripping structure to permit a user to removably fixate the apparatus to a vertical surface. An adjustable strap connects on each end to the collar, descending and looping around the sides and bottom of the canister to provide extra support for the canister.

In yet another embodiment, the collar features a receiving surface to which ornamental pieces, such as cartoon images or personal logos, may be attached to provide aesthetic appeal or advertisement.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

In the figures, the following components are represented by the corresponding reference numerals.

Collar—1000;
- Lever arm rotation member—1100;
- Vertical backing member—1200;
  - Suction cup backing—1210;
  - Backing member loop—1220;
- Wire support opening—1300;
- Handgrip holder—1400;
- Circular gripping structure—1500;
  - Support strap slits—1510;

Lever arm—2000;
- Rotational end—2100;
  - Lever arm rotation member opening—2110;
- Connective end—2200;
  - Connecting slit—2210;
  - Connecting wire divot—2220;
- Discharge nodule opening—2300;

Handgrip—3000;
- Rigid digit member—3100;
- Rotational gripping member—3200;
  - Superior distal end—3210;
  - Diverting middle portion—3220;
  - Inferior distal end—3230;
- Connecting wire—3300;
  - Connecting wire housing—3310;
- Connecting wire plug—3400;
- Wire anchor member—3500;

Support strap—4000;

Discharge nodules—5000; and
- Nodule plugs—5100.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF THE DRAWINGS

Disclosed is a canister holding apparatus that holds a skin-application product container and enables a user to remotely discharge the contents of the container.

Figure 1:
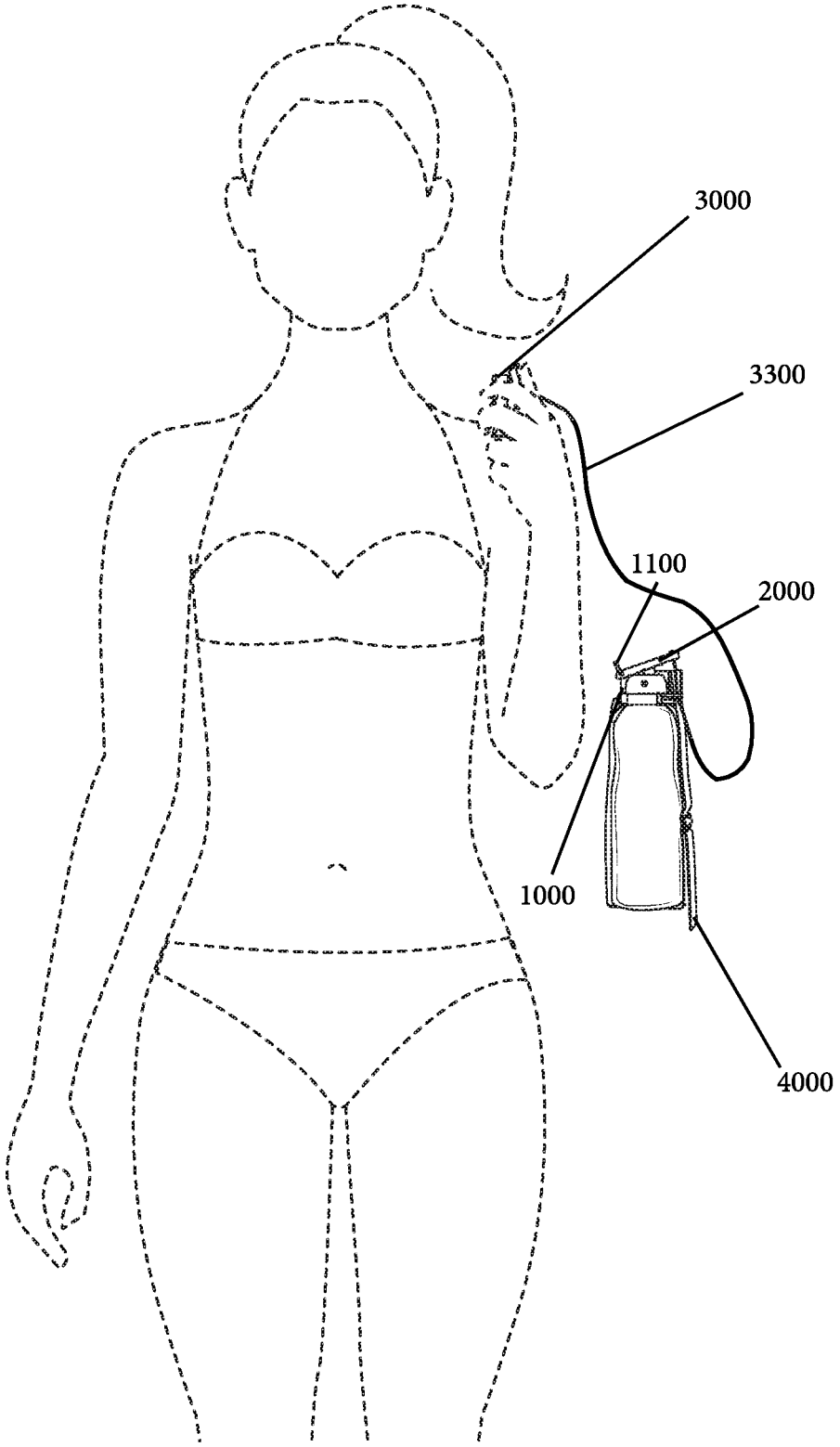
FIG. 1 is an environmental view of a canister holding apparatus fixated to a vertical surface behind a user.

FIG. 1 is an environmental view of the canister holding apparatus. As shown in FIG. 1, the apparatus features a collar 1000, a lever arm 2000, a handgrip 3000, and a support strap 4000. As shown, the collar 1000 may be removably attached to the actuator of a canister, via a gripping means, and attached to a vertical surface. The collar 1000 may be attached to a vertical surface at varying heights to accommodate the differing proportions of a user. Suitably, a user may attach the canister holding apparatus to a vertical surface at a height that aligns with the lower back, thereby permitting the user to squat whilst the canister discharges and, thus, coat the entirety of the back. In another embodiment, a user may simply hold the canister by its bottom in one hand behind the user's back, hold the handgrip 3000 with the other hand, and squeeze the handgrip 3000 to discharge the contents of the canister.

As shown in FIG. 1, the collar 1000 features attachment means for the support strap 4000 and lever arm 2000. As shown in FIG. 1, the support strap 4000 connects to the collar 1000 at two points. The support strap 4000 descends from its attachment points and loops around the sides and bottom of a canister to provide extra support for the canister as the collar 1000 is mounted to vertical surface, suspending the canister in the air. Further, the collar features a lever arm rotation member 1100 that extends outward from the collar 1000. As shown in FIG. 1, the lever arm rotation member 1100 inserts through a tunneled opening at one end of the lever arm 2000, thereby rotably fixating the lever arm 2000 at that end to the collar 1000.

Still referring to FIG. 1, the lever arm 2000 features a connection opening at its unattached end to which the connecting wire 3300 is threaded through and fixated. As shown, the connecting wire 3300 attaches at one end to the lever arm 2000 and to the handgrip 3000 at its opposite end. The handgrip 3000 is thereby tethered to the lever arm 2000 via its connection to the connecting wire 3300 and may be held by a user during use.

Figure 2:
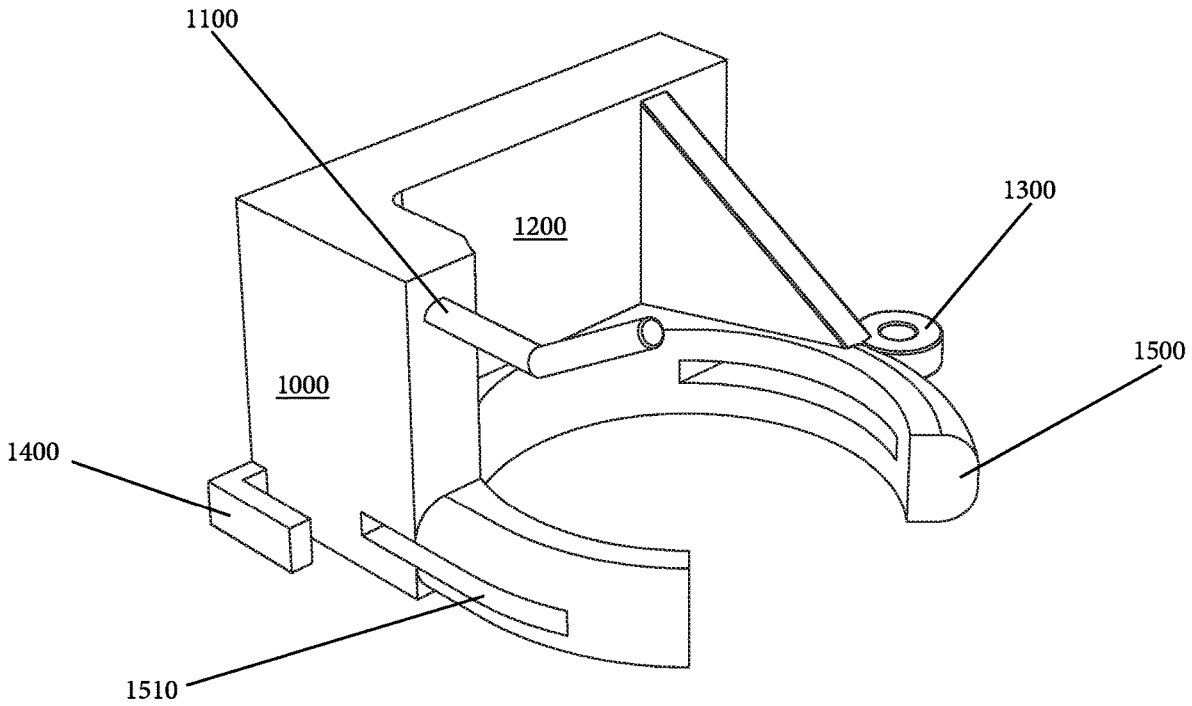
FIG. 2 is a perspective view of the collar.
Figure 3:
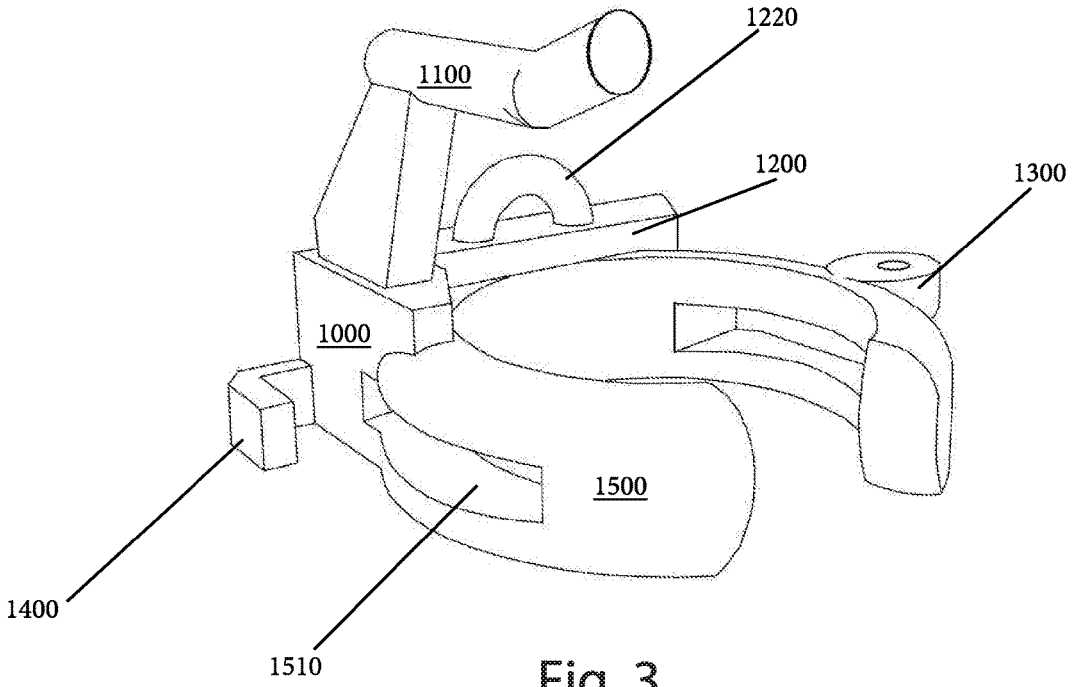
FIG. 3 is a perspective view of the collar with a backing member loop.

Referring to FIGS. 2 and 3, the collar 1000 features a circular gripping structure 1500 that encompasses and grips the typical circular canister actuator. The circular gripping structure 1500 is non-continuous, resembling a "C" shape. The non-continuous construction of the circular gripping structure 1500 permits the circular gripping structure 1500 to expand in circumference and apply sufficient gripping pressure to grip canisters of varying sizes, thus securing the collar 1000 to the canister at its actuator point. The grip of the circular gripping structure 1500 partially encompasses and supports the canister at the actuator point, permitting the suspension of the canister by the actuator as the collar 1000 is fixated to a vertical surface. Additionally, the circular gripping structure 1500 features support strap slits 1510 and a connecting wire opening 1300. As shown in the Figures, the support strap slits 1510 penetrate the vertical rim of the circular gripping structure 1500 and provide openings through which the support strap 4000 (as shown in FIG. 1) may be threaded, thereby fixating the support strap 4000 to the collar 1000. In one embodiment, the support strap 4000 (shown in FIG. 1) provides all the suspension support for the weight of the canister while the circular gripping structure 1500 loosely encompasses the canister actuator and impedes the canister from sliding forward when the lever arm 2000 (shown in FIG. 1) is activated. In another embodiment, the collar 1000 features a twist knob that permits a user to adjust the circumference of the circular gripping structure 1500, thereby sufficiently gripping the actuator of a canister and supporting its weight.

Also shown in FIGS. 2 and 3, the connecting wire opening 1300 extends from the exterior vertical surface of the circular gripping structure 1500 and features a receiving opening through which the connecting wire 3300 (as shown in FIG. 1) may be threaded.

Figure 7:
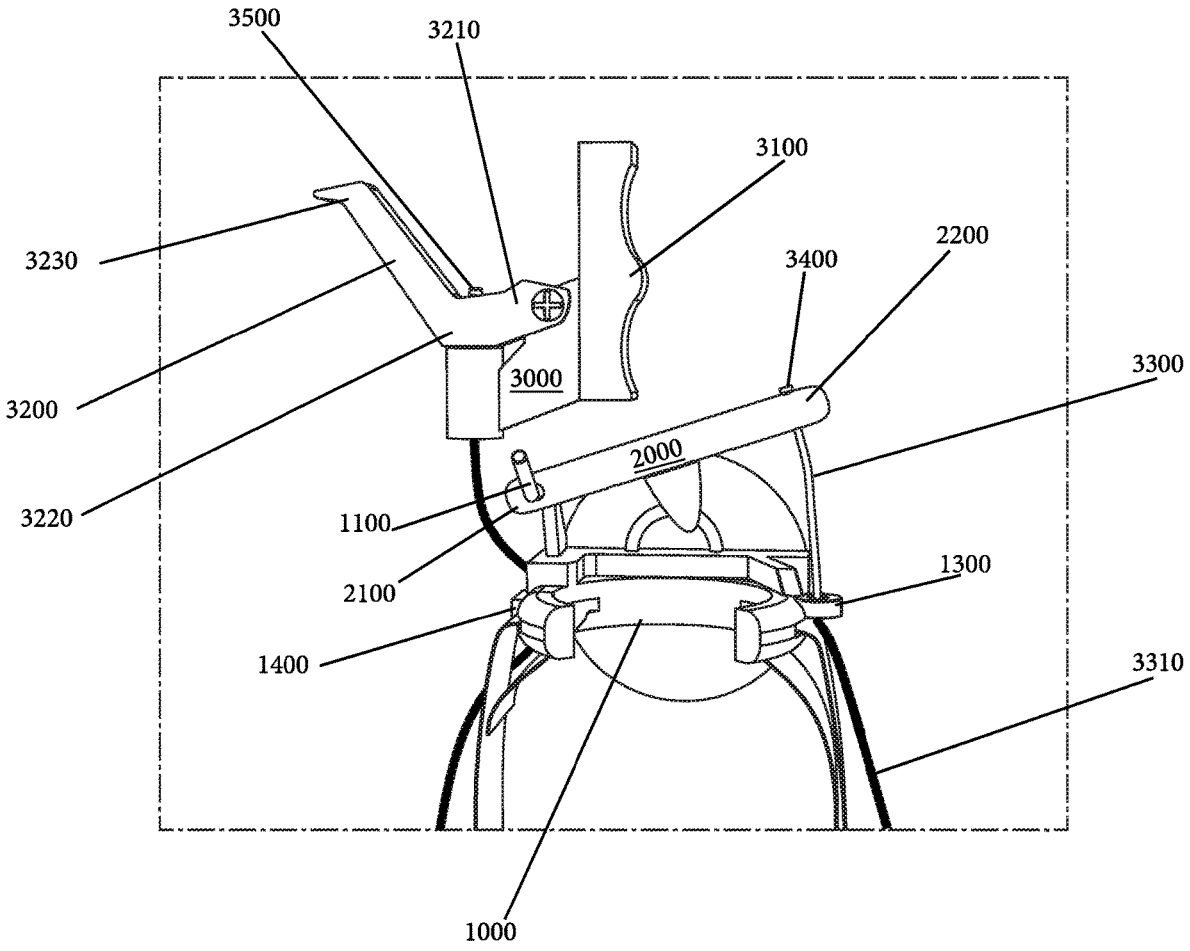
FIG. 7 is a perspective view of the canister holding apparatus.

Still referring to FIGS. 2 and 3, the collar 1000 further features a vertical backing member 1200 that is attached to the posterior continuous portion of the circular gripping structure 1500 of the collar 1000 and extends upwards from the circular gripping structure 1500. As shown, the lever arm rotational member 1100 extends forward from the vertical backing member 1200 and above the circular gripping structure 1500. Additionally, the vertical backing member 1200 features a handgrip holder 1400 that extends rigidly outward from the vertical backing member 1200. The handgrip holder 1400 provides an attachment means for the handgrip 3000 (as shown in FIG. 7) to which the handgrip 3000 may be temporarily and removably attached to the collar 1000 when not in use. Preferably, the handgrip holder 1400 may feature an "L" or "J" shape. In an alternative design, as shown in FIG. 3, the vertical backing member 1200 may be truncated and feature a backing member loop 1220 whereby the apparatus may be hung from a hook, branch, rope, etc.

Figure 4:
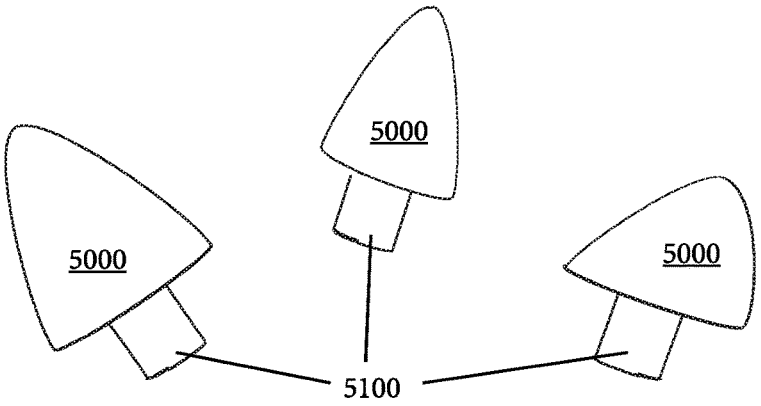
FIG. 4 is a perspective view of the varying sized removable discharge nodules.
Figure 5:
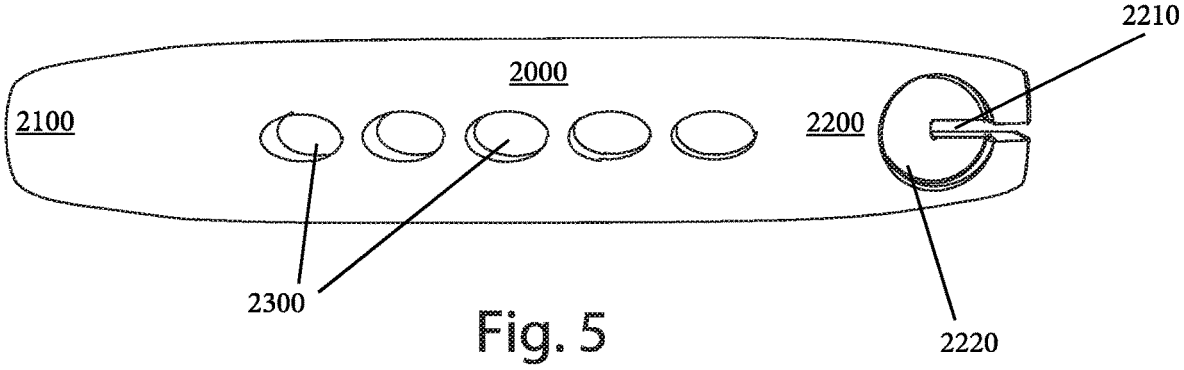
FIG. 5 is a top view of the lever arm.
Figure 6:
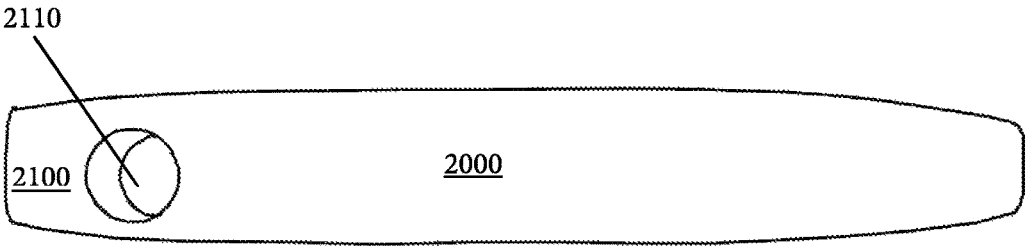
FIG. 6 is a front view of the lever arm showing the lever arm rotation member opening.

FIG. 4 shows the removable discharge nodules 5000 and nodule plugs 5100. The discharge nodule openings 2300 (FIG. 5) receive the nodule plugs 5100 of the discharge nodules 5000 via insertion, thereby removably fixating the discharge nodule 5000 to the lever arm 2000 (FIGS. 5 and 6). The discharge nodules 5000 may be removed and re-inserted in any of the discharge nodule openings 2300 (FIG. 5) along the length of the lever arm 2000 (FIGS. 5 and 6) to accommodate differing sizes of canister actuators. Further, discharge nodules 5000 of differing heights may also be selected and inserted in any of the discharge nodule openings 2300 (FIG. 5) along the length of lever arm 2000 (FIGS. 5 and 6) in order to accommodate differing sizes of canister actuators.

FIG. 5 is a perspective view of the lever arm 2000 and discharge nodule openings 2300 from above. As shown, the connective end 2200 features a connecting slit 2210 and a connecting wire divot 2220. The connecting slit 2210 penetrates the lever arm vertically beginning from the center of the connecting wire divot 2220 and traversing laterally to the end of the connective end 2200 of the lever arm 2000—creating a channeled slit. The discharge nodule openings 2300 partially penetrate the lever arm 2000 vertically and laterally align with the connecting wire divot 2220 of the connective end 2200. In one embodiment, the lever arm 2000 features one continuous slit along which a discharge nodule 5000 may be inserted and slid along the length of lever arm 2000.

As shown in FIGS. 5 and 6, the lever arm 2000 features a rotational end 2100. FIG. 6 is a front view of the lever arm 2000. Referring to FIG. 6, the rotational end 2100 features the lever arm rotation member opening 2110—a horizontal opening through which the lever arm rotation member 1100 of the collar 1000 (shown in FIGS. 2 and 3) is inserted, thereby rotably fixating the lever arm 2000 to the collar 1000.

FIG. 7 is a perspective view of the canister holding apparatus assembled. As shown in FIG. 7, the lever arm 2000 is fixated to and suspended superiorly over the collar 1000 via insertion of the lever arm rotation member 1100 through the horizontal opening in the rotational end 2100 of the lever arm 2000. The lever arm 2000 is also fixated to the connecting wire 3300 at its connective end 2200. As shown, the connecting wire 3300 is encompassed by a connecting wire housing 3310 that extends the length of the connecting wire 3300 from the handgrip 3000 to the connecting wire opening 1300 of the collar 1000. The connecting wire opening 1300 of the collar 1000 is of a size too small for the connecting wire housing 3310 to pass through, thereby allowing only the connecting wire 3300 to pass through the collar 1000 and connect to the lever arm 2000. The connecting wire 3300 passes through the connecting slit 2210 (shown in FIG. 5) and conjoins to the connecting wire divot 2220 (also shown in FIG. 5). The connecting wire 3300 features a connecting wire plug 3400, which is of a size larger than the connecting slit 2210 (shown in FIG. 5), therefore preventing the connecting wire 3300 from passing through the connective end 2200 of the lever arm 2000. This connection between the connecting wire 3300 and the lever arm 2000 facilitates the transfer of a pulling force initiated by the handgrip 3000, connected to the opposing end of the connecting wire 3300, to the connective end 2200 of the lever arm 2000. Such pulling force on the opposing end of the connecting wire 3300 pulls on the connective end 2200 of the lever arm 2000 causing both the connective end 2200 to descend and the rotational end 2100 of the lever arm 2000 to rotate around the lever arm rotation member 1100.

FIG. 7 also shows the handgrip 3000. The handgrip 3000 is held by a user during operation and comprises a rotational gripping member 3200 and a rigid digit member 3100. The rotational gripping member 3200 further comprises a superior distal end 3210, a diverting middle portion 3220, and an inferior distal end 3230. The rotational gripping member 3200 is connected to the rigid digit member 3100 at the superior distal end 3210 through insertion of a typical screw through an opening in the rotational gripping member 3210 and through an opening of the rigid digit member 3100, permitting the rotation of the rotational gripping member 3200 around the conjoined openings.

A pulling force is created on the connecting wire 3300 by a clamping of the rotational gripping member 3200 and rigid digit member 3100, driving the rotational gripping member 3200 towards the rigid digit member 3100. The connecting wire housing 3310 is of a size too big to pass through the opening in the diverting middle portion 3220, and, therefore, provides resistance against the handgrip 3000 when it is clamped as such, translating the pulling force to the connecting wire 3300. As shown in FIG. 7, the inferior end of the connecting wire 3300 passes through an opening in the diverting middle portion 3220 of the rotational gripping member 3200 while the superior end of the connecting wire 3300 passes through the connecting slit 2210 (shown in FIG. 5) of the lever arm 2000. The inferior end of the connecting wire 3300 is fixated to a wire anchor member 3500. The wire anchor member 3500 is of a size larger than the opening of the diverting middle portion 3220 such that the mismatch in circumference prevents the connecting wire 3300 from passing through the opening in the diverting middle portion 3220. This impediment of motion through the opening in the diverting middle portion 3220 causes any pulling force induced on the wire anchor member 3500 to then be induced upon the connecting wire 3300.

Still referring to FIG. 7, the superior end of the connecting wire 3300 is connected to the connecting wire plug 3400 which rests in the connecting wire divot 2220 (shown in FIG. 5) of the connective end 2200 of the lever arm 2000, and is of a size larger than the connecting slit 2210. The mismatch in size of the connecting slit 2210 and the connecting wire plug 3400 prevents the motion of the connecting wire 3300 through the connecting slit 2210. This impediment of motion through the connecting slit 2210 (shown in FIG. 5) translates any pulling force induced upon the connecting wire 3300 to the connective end 2200 of the lever arm 2000.

Also shown in FIG. 7 is the wire support opening 1300 and handgrip holder 1400. The wire support opening 1300 extends from the collar 1000 and features an opening through which the connecting wire 3300 is thread through. The wire support opening 1300 fully encircles the connecting wire 3300 and ensures that the connecting wire 3300 will remain in line with the opening of the connective end 2200 of the lever arm 2000, thereby preventing the connecting wire 3300 from sliding laterally outward through the connective slit 2210 (shown in FIG. 5) and, thus, disconnecting from the lever arm 2000. The connecting wire housing 3310 encircles the connecting wire 3300, but has a circumference too large to pass through the wire support opening 1300. The handgrip holder 1400 likewise extends outward from the collar 1000. The handgrip holder 1400 provides a resting structure which the connecting wire 3300 may pass through and the handgrip 3000 may rest upon when the apparatus is not in use.

Figure 8:
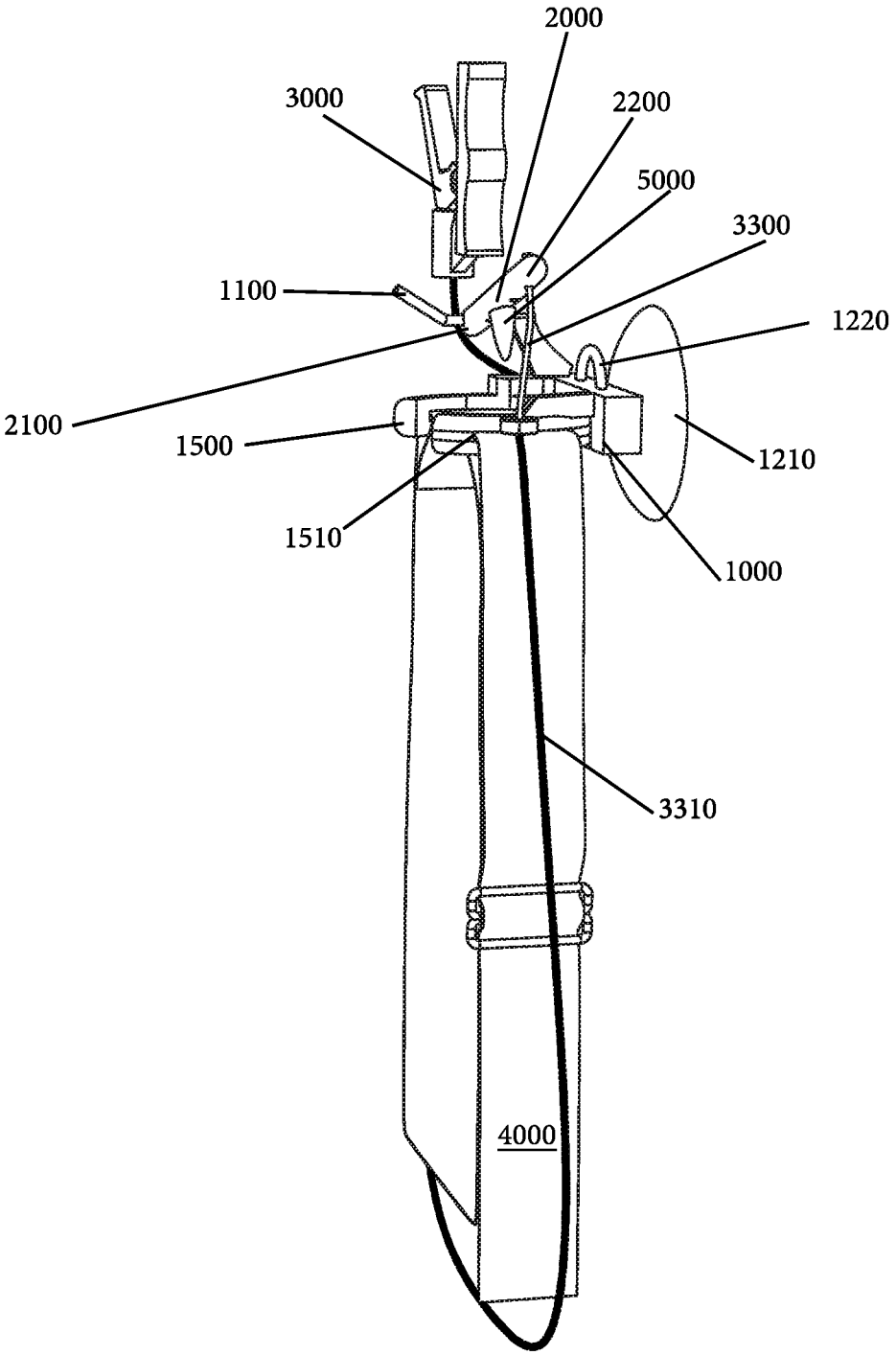
FIG. 8 is a side view of the canister holding apparatus.

FIG. 8 shows a side view of the canister-holding apparatus. As shown, the connecting wire 3300 connects the handgrip 3000 to the lever arm 2000 such that a pulling force originating from the handgrip 3000 is transferred first to the connecting wire 3300 and connecting wire housing 3310 and then subsequently to the connective end 2200 of the lever arm 2000. The connecting wire 3300 is conjoined to the lever arm 2000 such that any force induced on the connecting wire 3300 is induced upon the connective end 2200 of the lever arm 2000, thereby causing a descension of the connective end 2200 of the lever arm 2000 when a pulling force is induced by the handgrip 3000. The descension of the connective end 2200 of the lever arm 2000 causes the simultaneous rotation of the rotational end 2100 around the lever arm rotation member 1100. This simultaneous descension and rotation of the lever arm 2000 drives the discharge nodule 5000 inserted into the lever arm 2000 downwards, towards the depressible actuator of a canister held by the collar 1000. The connecting wire 3300 pulls the connective end 2200 downwards so that the discharge nodule 5000 makes contact with the canister actuator and applies a downwards force on the actuator such that the actuator depresses and the canister contents are discharged. A release of the handgrip 3000 removes the pulling force on the connecting wire 3300 which, in turn, releases the pulling force on the connective end 2200 of the lever arm 2000, causing the connective end 2200 to ascend to its resting position and break the connection of the discharge nodule 5000 and the actuator of the canister—ceasing the release of canister contents.

Also shown in FIG. 8, the vertical backing member 1200 features a receiving surface to which attachment means, such as magnets, Velcro®, or a suction cup backing 1210 may be fixated. The vertical backing member 1200 may feature a backing member loop 1220 whereby the apparatus may be hung from a receiving structure such as a hook or branch. The vertical backing member 1200 may feature embedded magnets, a suction cup backing 1210, and a backing member hook 1220 simultaneously. Further, FIG. 8 shows the support strap 4000 without a canister. As shown, the support strap 4000 connects to the circular gripping structure 1500 of the collar 1000 by descending from one support strap slit 1510, looping upwards, and reconnecting to second support strap slit 1510 of the circular gripping structure 1500.

In an alternative embodiment, the collar features an attachment means by which the apparatus may be fixated to a mountable automated track. The apparatus may be powered by insertable batteries and a motor which may be activated by a motion sensor or a wireless remote control, eliminating the necessity of an attached handgrip. The automated track may be fixated to any vertical surface via the disclosed attachment means above (suction cup, magnets, hook, etc.). The automated track sways the canister from side-to-side while simultaneously moving the canister up and down the track vertically, allowing for an automated discharge and distribution of the canister contents.

In yet another embodiment, multiple apparatuses may be aligned in tandem on a vertical surface and simultaneously activated when a user grips the handgrip, translating a force from a single wire attached thereto to both apparatuses.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments. In particular, the disclosure is recited in the context of applying aerosoled sunscreen but other aerosoled products (including spray on medications and other spray-on topical products) could also be incorporated into the devices and methodologies described.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A spray canister holding apparatus comprising:

a collar sized to secure a spray canister therein such that a spray dispenser nozzle of the spray canister is oriented away from the collar;

a mechanical lever positioned with the collar such that, when the collar secures the spray canister, the mechanical lever is configured to depress a dispenser button on the spray canister;

a backing member connected to the collar, the backing member having a surface to rest against and be removably attachable to a wall surface such that the collar protrudes from the wall surface; and a lever support extending from the backing member above the collar and supporting the mechanical lever rotationally.

2. The spray canister holding apparatus according to claim 1, further comprising a dispenser nodule attached to the mechanical lever and positioned to align with the dispenser button on the spray canister.

3. The spray canister holding apparatus according to claim 2, wherein the mechanical lever includes a plurality of nodule openings into one of which the dispenser nodule is selectively positioned so as to accurately align with the dispenser button on the spray canister.

4. The spray canister holding apparatus according to claim 1, further comprising a connecting wire attached to the mechanical lever such that movement of the wire actuates rotation of the mechanical lever to depress the dispenser button on the spray canister.

5. The spray canister holding apparatus according to claim 4, wherein the connecting wire is attached to the mechanical lever at a first end of the connecting wire, and wherein the spray canister holding apparatus further comprises a handgrip attached to a second end of the connecting wire, with which the mechanical lever is actuatable.

6. The spray canister holding apparatus according to claim 1, wherein the backing member includes a suction cup.

7. The spray canister holding apparatus according to claim 1, further comprising one or more support straps attached to the collar to support the spray canister when connected to the collar.

8. A spray canister holding apparatus comprising:

a collar sized to secure a spray canister therein such that a spray dispenser nozzle of the spray canister is oriented away from the collar;

a mechanical lever positioned with the collar such that, when the collar secures the spray canister, the mechanical lever is actuatable to depress a dispenser button on the spray canister;

a connecting wire having a first end and a second end, the first end attached to the mechanical lever, the connecting wire extending a length from the spray canister holding apparatus;

a handgrip attached to the second end of the connecting wire, the handgrip being configured to actuate the mechanical lever to depress the dispenser button on the spray canister by a user when the user is facing away from the spray canister holding apparatus; and a backing member connected to the collar, the backing member being removably attachable to a wall surface such that the collar protrudes from the wall surface.

9. The spray canister holding apparatus according to claim 8, further comprising one or more support straps attached to the collar to support the spray canister when connected to the collar.

10. The spray canister holding apparatus according to claim 9, wherein the one or more support straps are secured to the collar through slits in opposing sides of the collar.

11. The spray canister holding apparatus according to claim 8, wherein the collar is semi-circular.

12. The spray canister holding apparatus according to claim 8, wherein the collar is adjustable to accommodate different sizes of spray canisters.

13. The spray canister holding apparatus according to claim 8, wherein the mechanical lever is actuatable via squeezing the handgrip.

14. The spray canister holding apparatus according to claim 8, further comprising a suction cup that is removably attachable to the backing member.

15. A spray canister holding method comprising:

attaching a backing member to a wall, the backing member connected to a collar, and the backing member having a surface to rest against and be removably attached to a wall surface such that the collar protrudes from the wall surface;

securing a spray canister within the collar such that a spray dispenser nozzle of the spray canister is oriented away from the collar; and actuating a mechanical lever positioned with the collar such that the mechanical lever depresses a dispenser button on the spray canister, wherein the collar has attached thereto one or more support straps to support the spray canister when connected to the collar, the one or more support straps being secured to the collar through slits in opposing sides of the collar.

16. The spray canister holding method according to claim 15, further comprising squeezing a handgrip connected to a wire attached to the mechanical lever to cause the mechanical lever to depress the dispenser button on the spray canister.

17. The spray canister holding method according to claim 15, wherein the securing the spray canister includes supporting the spray canister from underneath the spray canister via one or more straps extending from the collar.

18. The spray canister holding method according to claim 15, wherein the attaching the backing member includes hanging the backing member against the wall surface via one of a hook, a screw, or nail protruding from the wall surface on a loop integrated in the backing member.

19. The spray canister holding method according to claim 15, wherein the actuating the mechanical lever includes pressing a button on a wireless electronic remote.

20. The spray canister holding method according to claim 15, further comprising extending a handgrip attached to the mechanical lever via a connecting wire away from the collar such that a user actuates the mechanical lever via the handgrip while facing away from the spray canister.

* * * * *